US007427721B2

(12) United States Patent
Muneyoshi et al.

(10) Patent No.: US 7,427,721 B2
(45) Date of Patent: Sep. 23, 2008

(54) COMPOUND SWITCH

(75) Inventors: Miyata Muneyoshi, Tokyo (JP); Satoshi Myoujin, Tokyo (JP); Tsuyoshi Noguchi, Tokyo (JP)

(73) Assignee: MIK Electronic Corporation, Tokyo (JP)

( * ) Notice: Subject to any disclaimer, the term of this patent is extended or adjusted under 35 U.S.C. 154(b) by 76 days.

(21) Appl. No.: 11/458,157

(22) Filed: Jul. 18, 2006

(65) Prior Publication Data

US 2007/0017787 A1 Jan. 25, 2007

(30) Foreign Application Priority Data

Jul. 25, 2005 (JP) ..... 2005-214989

(51) Int. Cl.
*H01H 25/04* (2006.01)

(52) U.S. Cl. ..... 200/4; 200/14; 200/6 A

(58) Field of Classification Search ..... 200/4, 200/5 R, 14, 6 A, 17 R, 18; 74/471; 341/20–22, 341/35; 345/156, 157, 160, 161, 168, 169, 345/184

See application file for complete search history.

(56) References Cited

U.S. PATENT DOCUMENTS 6,420,667 B1 * 7/2002 Miwa et al. ..... 200/4
6,720,504 B2 * 4/2004 Nishimoto et al. ..... 200/4
6,953,900 B2 * 10/2005 Sottong ..... 200/5 R
6,965,084 B2 * 11/2005 Kumasaka et al. ..... 200/6 A
7,087,848 B1 * 8/2006 Yamasaki et al. ..... 200/6 A
7,123,473 B2 * 10/2006 Xu ..... 200/5 R
7,145,088 B2 * 12/2006 Sunadome et al. ..... 200/6 A
7,193,166 B2 * 3/2007 Sakurai et al. ..... 200/5 R
7,214,894 B1 * 5/2007 Kakuno et al. ..... 200/6 A

* cited by examiner

*Primary Examiner*—Michael A Friedhofer
(74) *Attorney, Agent, or Firm*—Norris McLaughlin & Marcus, PA

(57) ABSTRACT

There is provided a compound switch suitable for preventing malfunction as a multidirectional switch caused by an unreasonable turning force applied to a slider, improving the switch operability, and simplifying a switch mounting panel surface. When a transverse push-in force is applied to the operating portion 14, the slider 8 slides in the push-in direction of the operating portion from a fixed position of neutrality, and hence a contact state corresponding to the slide direction can be obtained. When torque for turning the operating portion 14 around the axis thereof is applied to the operating portion 14, the torque is transmitted to an outer base 2 via the slider 8 etc., by which the outer base 2, the slider 8, and the operating portion 14 are rotatingly moved together in the rotation direction of the operating portion 14 from the fixed position of neutrality, and hence a contact state corresponding to the rotation direction can be obtained.

6 Claims, 17 Drawing Sheets

EIGHT-DIRECTION SWITCH FUNCTIONING

SHUTTLE SWITCH FUNCTIONING
FIG. 3A
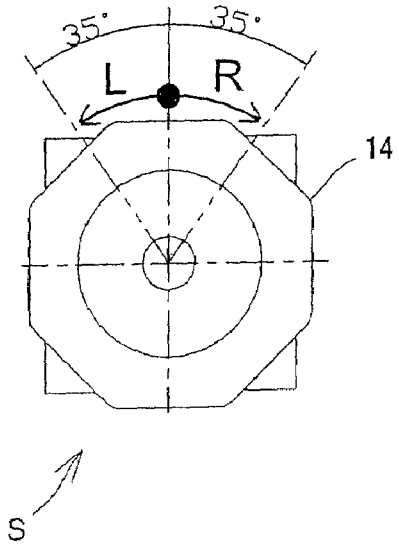
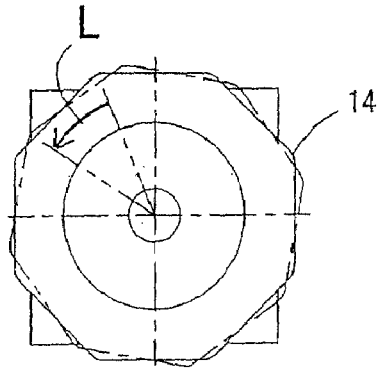
FIG. 3B

FIG. 10F SECT B-B

FIG. 10E SECT A-A

FIG. 11D
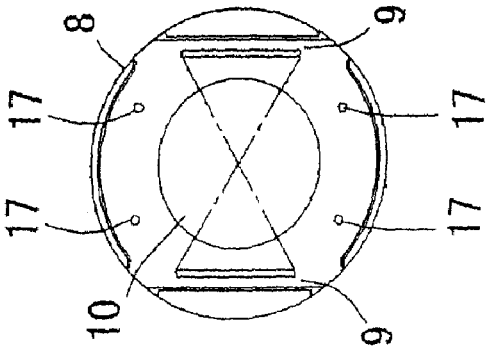
FIG. 11F
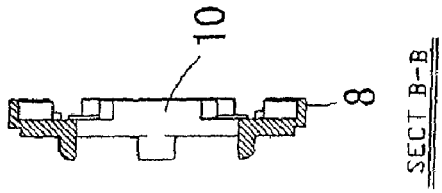
FIG. 11C
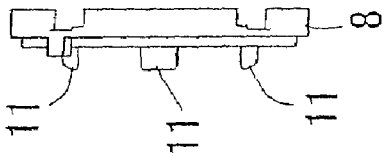
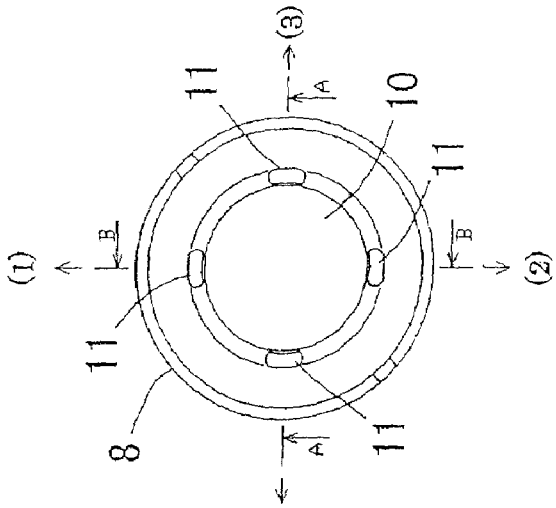
FIG. 11B
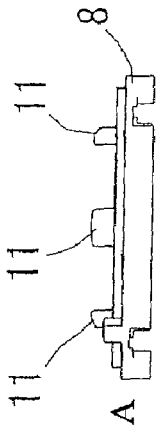
FIG. 11A
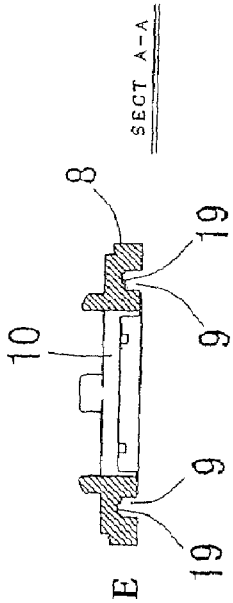
FIG. 11E

SECT A-A

COMPOUND SWITCH

BACKGROUND OF THE INVENTION

1. Field of the Invention

The present invention relates to a compound switch that is used as an operating switch etc. for operating a car navigation system or other on-vehicle equipment.

2. Description of the Related Art

As the car navigation systems have come into wide use, the number of vehicles including a car navigation system as standard equipment has increased. In the case where the car navigation system is included as standard equipment, a center control switch for operating the car navigation system is integrally assembled on the front surface of a dashboard.

The center control switch of this type has a large number of switch operating portions such as eight independent eight-direction buttons, which are used when a cursor on a car navigation operation screen is operated, and a determination button. On the other hand, on the front surface of the dashboard, the operating portions of various switches such as an air conditioner operating switch that has existed before the widespread use of car navigation system are also assembled integrally. Therefore, in the case where the car navigation system is included as standard equipment, the number of switch operating portions arranged in a planar form on the front surface of dashboard increases inevitably, so that the front surface of dashboard becomes complicated, and also the switch operability decreases.

As means for solving this problem, it is likely that a multidirectional switch described in Japanese Patent Laid-Open No. 2003-59374 is used.

The multidirectional switch described in Japanese Patent Laid-Open No. 2003-59374 is configured so that merely by sliding one slider capable of being slid in multiple directions on the same plane in eight directions, a switch operation equivalent to the eight independent eight-direction buttons can be performed. Therefore, by the use of the multidirectional switch described in Japanese Patent Laid-Open No. 2003-59374, the number of switch operating portions arranged in a planar form on the front surface of dashboard is decreased.

However, there is a limit to the decrease in the number of switch operating portions attained by the use of the multidirectional switch described in Japanese Patent Laid-Open No. 2003-59374 because of the construction and operation of the multidirectional switch. Therefore, there is a possibility that the multidirectional switch described in Japanese Patent Laid-Open No. 2003-59374 may be unable to sufficiently accommodate the increase in the number of switch operating portions predicted in the future. It is predicted that other switch operating portions may be added newly around the multidirectional switch. In this case, the number of switch operating portions arranged in a planar form on the front surface of dashboard increases again, which presents a problem in that the front surface of dashboard becomes complicated, and also the switch operability decreases.

Also, since the multidirectional switch described in Japanese Patent Laid-Open No. 2003-59374 has a construction such that one slider is slid in multiple directions on the same plane, if an unreasonable force such as to turn the slider is applied to the slider, the slider, a guide means for the slider, or the like is damaged. As a result, the slider becomes incapable of being slid in any direction, and thus malfunction as a multidirectional switch occurs.

In the multidirectional switch of this type, if the outer periphery of the switch operating portion for sliding the slider is formed into a polygonal shape having sides of the same number as the number of sliding directions to make the switch operator intuitively perceive the directions to which the slider can be slid, the possibility of the occurrence of the above-described trouble further increases. The reason for this is that the switch operator misunderstands as if the switch operating portion that cannot inherently be turned may be able to turn because the external shape of switch operating portion looks like the external shape of a bolt head or a nut, so that it is likely that chances of intending to turn the slider forcibly via the switch operating portion increase.

SUMMARY OF THE INVENTION

The present invention has been made to solve the above problems, and accordingly an object thereof is to provide a compound switch suitable for preventing malfunction as a multidirectional switch caused by an unreasonable turning force applied to a slider, improving the switch operability, and simplifying a switch mounting panel surface.

To achieve the above object, the present invention provides a compound switch functioning as a multidirectional switch capable of obtaining a contact state corresponding to the slide direction sliding in the push-in direction and also functioning as a rotary shuttle switch capable of obtaining a contact state corresponding to the rotation direction by an operation for pushing in one operating portion in the transverse direction or an operation for turning the operating portion around the axis thereof.

The compound switch in accordance with the present invention includes a multiple base in which a cup-shaped inner base and a cup-shaped outer base are arranged double on an inside and an outside so as to be turnably; a slider which is provided slidably on an upper surface of a bottom part of the outer base and is integrally mounted with the operating portion at an outer periphery; a guide means which is provided between the slider and the outer base to slidably guide the slider in multiple directions on the upper surface of the bottom part of the outer base; a first urging means for always urging the slider against a fixed position of neutrality; a second urging means for always urging the outer base against a fixed position of neutrality; an outer base fixed contact pattern provided integrally on the upper surface of the bottom part of the outer base; a slide brush integrally attached to a lower surface of the slider so as to face to the outer base fixed contact pattern; a rotary brush integrally provided on the outer base so as to face to an outer surface of a bottom part of the inner base; and an inner base fixed contact pattern integrally provided on an upper surface of the bottom part of the inner base so as to face to the rotary brush, and is configured so that when a transverse push-in force is applied to the operating portion, the slider slides in a push-in direction of the operating portion from the fixed position of neutrality against an urging force of the first urging means, and at this time, the slide brush and the outer base fixed contact pattern form a contact state corresponding to the slide direction, and when torque for turning the operating portion around an axis thereof is applied to the operating portion, the torque is transmitted to the outer base via the slider and the guide means, by which the outer base and the operating portion are rotatingly moved together in a rotation direction of the operating portion from the fixed position of neutrality against an urging force of the second urging means, and at this time, the rotary brush and the inner base fixed contact pattern form a contact state corresponding to the rotation direction.

Also, the compound switch in accordance with the present invention includes a multiple base in which a cup-shaped inner base and a cup-shaped outer base are arranged double on an inside and an outside so as to be turnably; a slider which is provided slidably on an upper surface of a bottom part of the outer base and is integrally mounted with the operating portion at an outer periphery; a guide means which is provided between the slider and the outer base to slidably guide the slider in multiple directions on the upper surface of the bottom part of the outer base; a first urging means for always urging the slider against a fixed position of neutrality; a second urging means for always urging the outer base against a fixed position of neutrality; an outer base fixed contact pattern provided integrally on the upper surface of the bottom part of the outer base; a slide brush integrally attached to a lower surface of the slider so as to face to the outer base fixed contact pattern; a rotary brush integrally provided on the outer base so as to face to an outer surface of a bottom part of the inner base; and an inner base fixed contact pattern integrally provided on an upper surface of the bottom part of the inner base so as to face to the rotary brush, the outer base fixed contact pattern being provided with an outer base fixed common contact for a multidirectional switch and a plurality of outer base fixed contacts, which are arranged so as to be distributed in all directions; the slide brush being provided with a plurality of slide contacts provided as slide contacts for the multidirectional switch so as to correspond to a slide common contact provided corresponding to the outer base fixed common contact and the outer base contacts; the rotary brush being provided with a plurality of rotary contacts, as rotary contacts for the multidirectional switch, which are connected electrically to the outer base fixed common contact and the outer base fixed contacts, and being provided with a rotary common contact and a rotary changeover contact connected electrically to the rotary common contact as rotary contacts for the rotary shuttle switch, these rotary contacts being arranged on a concentric circle with a bottom part center of the outer base being the center; and the inner base fixed contact pattern being provided with a plurality of inner base fixed contacts formed and arranged along contact rotation paths corresponding to the rotary contacts for the multidirectional switch and the rotary contacts for the rotary shuttle switch, and is configured so that when a transverse push-in force is applied to the operating portion, the slider slides in a push-in direction of the operating portion from the fixed position of neutrality against an urging force of the first urging means, and at this time, at least any one set of slide contact and outer base fixed contact, of the slide contacts and the outer base fixed contacts, come into contact with each other according to the slide direction, and a state in which the slide common contact and the outer base fixed common contact are in contact with each other is formed, and when torque for turning the operating portion around an axis thereof is applied to the operating portion, the torque is transmitted to the outer base via the slider and the guide means, by which the outer base and the operating portion are rotatingly moved together in the rotation direction of the operating portion from the fixed position of neutrality against an urging force of the second urging means, and at this time, the rotary changeover contact comes into contact with the corresponding inner base fixed contact according to the rotation direction, and a state in which the rotary common contact is in contact with the corresponding inner base fixed contact is formed.

The operating portion may have a polygonal outer periphery.

The compound switch can adopt a construction such that a hole vertically penetrating bottom part centers of the inner and outer bases, centers of the slider and the switch operating portion, a center of the guide means, and a center of the slide brush is provided, and a palm rest is provided above the upper surface of the bottom part of the outer base via a fixing shaft inserted in the hole.

The first urging means can adopt a construction such that protrusions on an upper surface of the slider are arranged in a ring of a tightly wound coil spring set annularly. In the case where such a construction is adopted, since the first urging means is an annular tightly wound coil spring, even if the slider is slid in any direction, the same urging force always acts on the slider from the tightly wound coil spring. Therefore, a sense of strangeness such that the push-in force of the operating portion differs according to the slide direction is not felt in operation, and hence the switch operability can be improved.

Further, the compound switch in accordance with the present invention can adopt a construction such that when the operating portion is turned in either one direction of right and left, the rotary contact connected electrically to the outer base fixed common contact gets out of the corresponding inner base fixed contact, and hence a non-contact state is formed. In the case where such a construction is adopted, when the operating portion is turned, the rotary contact connected electrically to the outer base fixed common contact always gets out of the corresponding inner base fixed contact and hence a non-contact state is formed, so that the multidirectional switch does not operate when the operating portion is rotatingly operated. Therefore, even if the switch operator pushes in the operating portion mistakenly together with the operation for turning the operating portion, only a signal based on the turning operation is generated, and no signal based on the mistaken push-in operation is generated, so that the generation of wrong signal based on misoperation can be prevented.

The compound switch in accordance with the present invention functions as a multidirectional switch capable of obtaining a contact state corresponding to the slide direction sliding in the push-in direction and also functions as a rotary shuttle switch capable of obtaining a contact state corresponding to the rotation direction by the operation for pushing in one operating portion in the transverse direction or the operation for turning the operating portion around the axis thereof. Therefore, the number of switch operating portions arranged in a planar form on a switch mounting panel surface, for example, on the front surface of dashboard of a vehicle, so that the switch operability can be improved and the switch mounting panel surface can be simplified.

Also, the compound switch in accordance with the present invention has a construction such that when torque for turning the operating portion around the axis thereof is applied to the operating portion, the torque is transmitted to the outer base via the slider and the guide means, and thereby the outer base, the slider, and the operating portion are rotatingly moved together in the rotation direction of the operating portion from a fixed position of neutrality against the urging force of the second urging means. Therefore, even if the operating portion is turned, an unreasonable turning force does not act on the slider, so that malfunction as a multidirectional switch caused by the damage to the slider or the guide means therefor can be prevented effectively.

BRIEF DESCRIPTION OF THE DRAWINGS

FIG. 3A is an explanatory view of turning directions of the operating portion at the time when the compound switch shown in FIG. 1A functions as a rotary shuttle switch;

FIG. 3B is an explanatory view of an operation at the time when the operating portion is turned in the direction indicated by the arrow L in FIG. 3A;

FIG. 10E is a sectional view taken along the line A-A of FIG. 10B;

FIG. 10F is a sectional view taken along the line B-B of FIG. 10B;

FIG. 11A is a front view of the slider;

FIG. 11B is a plan view of the slider;

FIG. 11C is a side view of the slider;

FIG. 11D is a back view of the slider;

FIG. 11E is a sectional view taken along the line A-A of FIG. 11B;

FIG. 11F is a sectional view taken along the line B-B of FIG. 11B;

DETAILED DESCRIPTION OF THE PREFERRED EMBODIMENTS

A preferred embodiment of the present invention will now be described in detail with reference to the accompanying drawings.

Figure 1B:
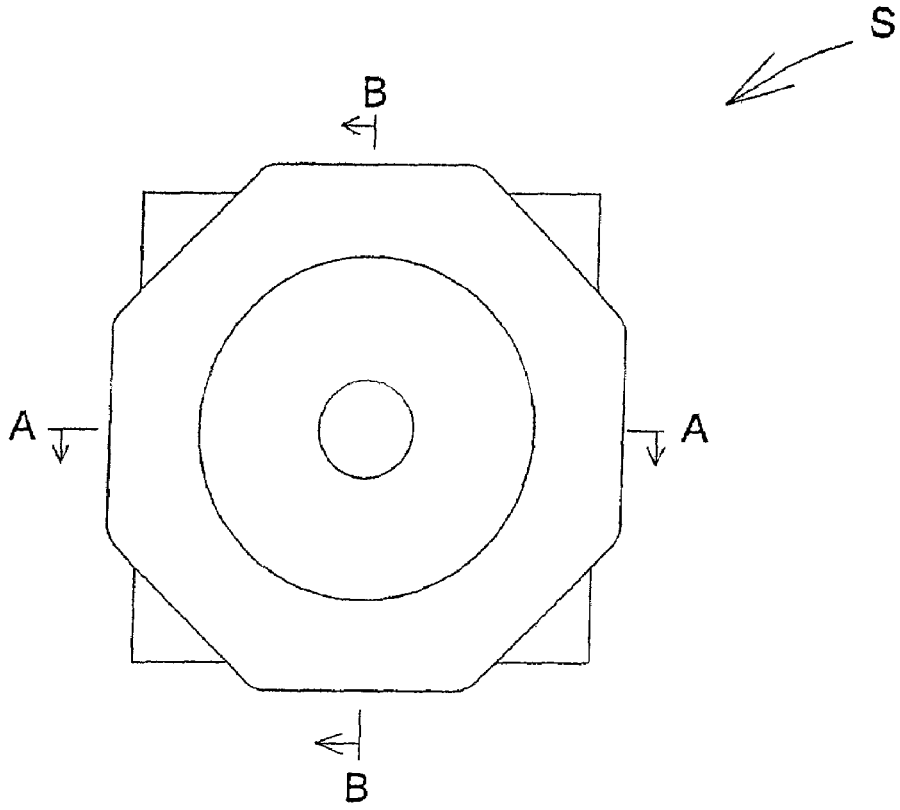
FIG. 1B is a plan view of FIG. 1A.
Figure 1A:
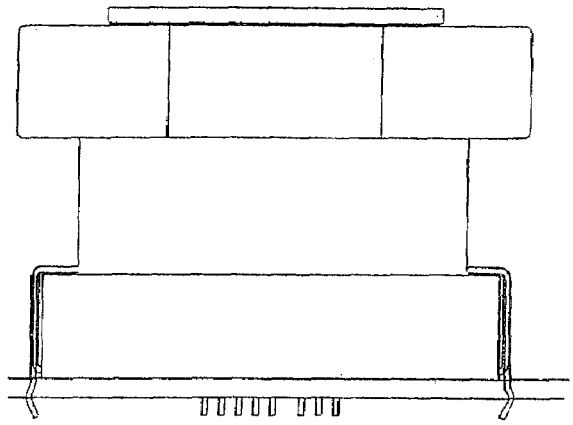
FIG. 1A is a front view of the compound switch in accordance with one embodiment of the present invention.
Figure 4:
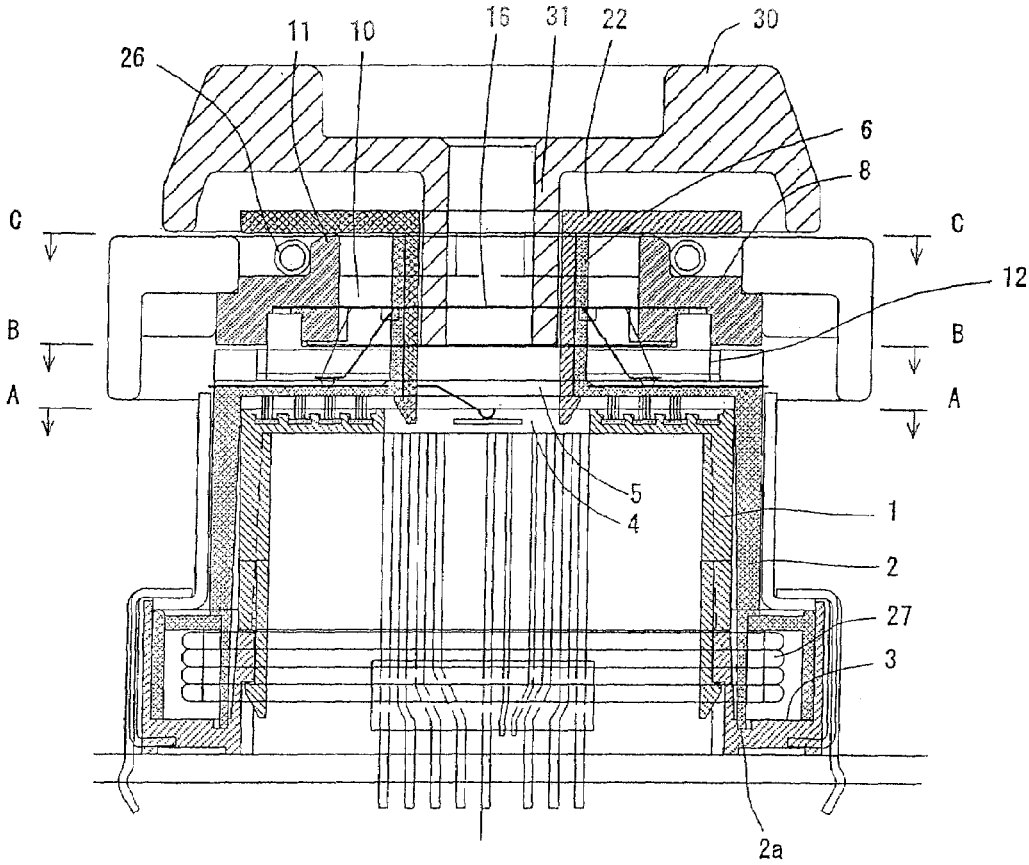
FIG. 4 is a sectional view taken along the line A-A of FIG. 1A.
Figure 5:
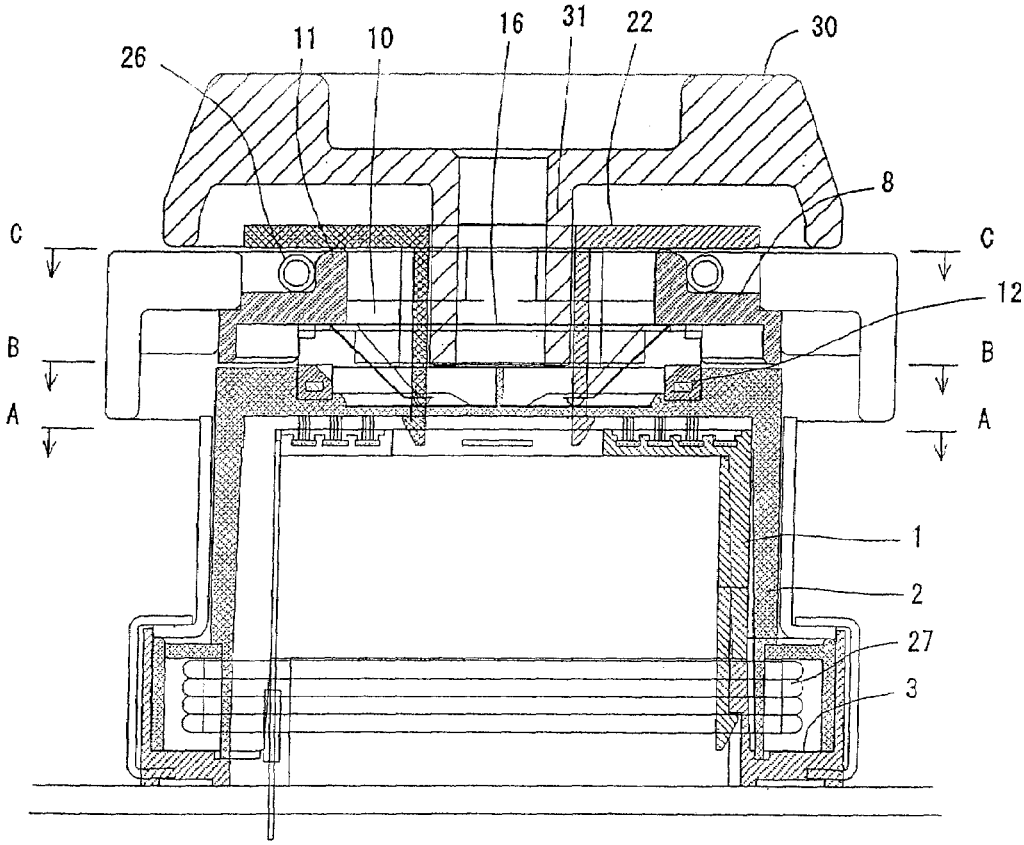
FIG. 5 is a sectional view taken along the line B-B of FIG. 1A.
Figure 6:
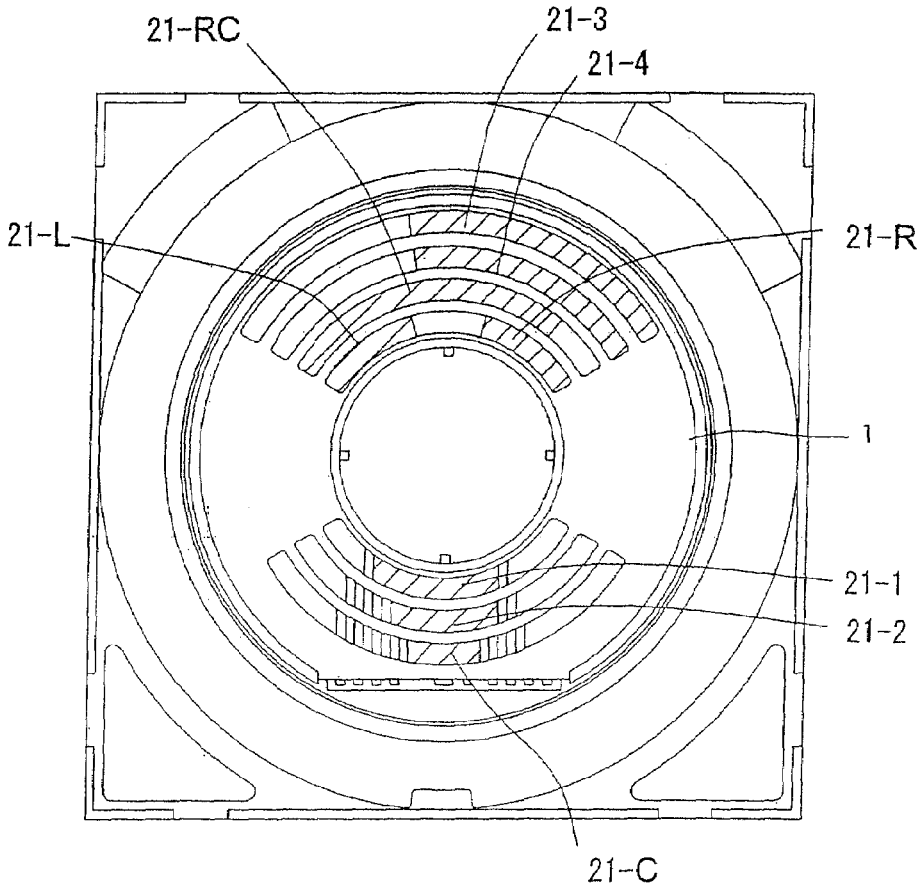
FIG. 6 is a sectional view taken along the line A-A of FIG. 4 or 5.
Figure 7:
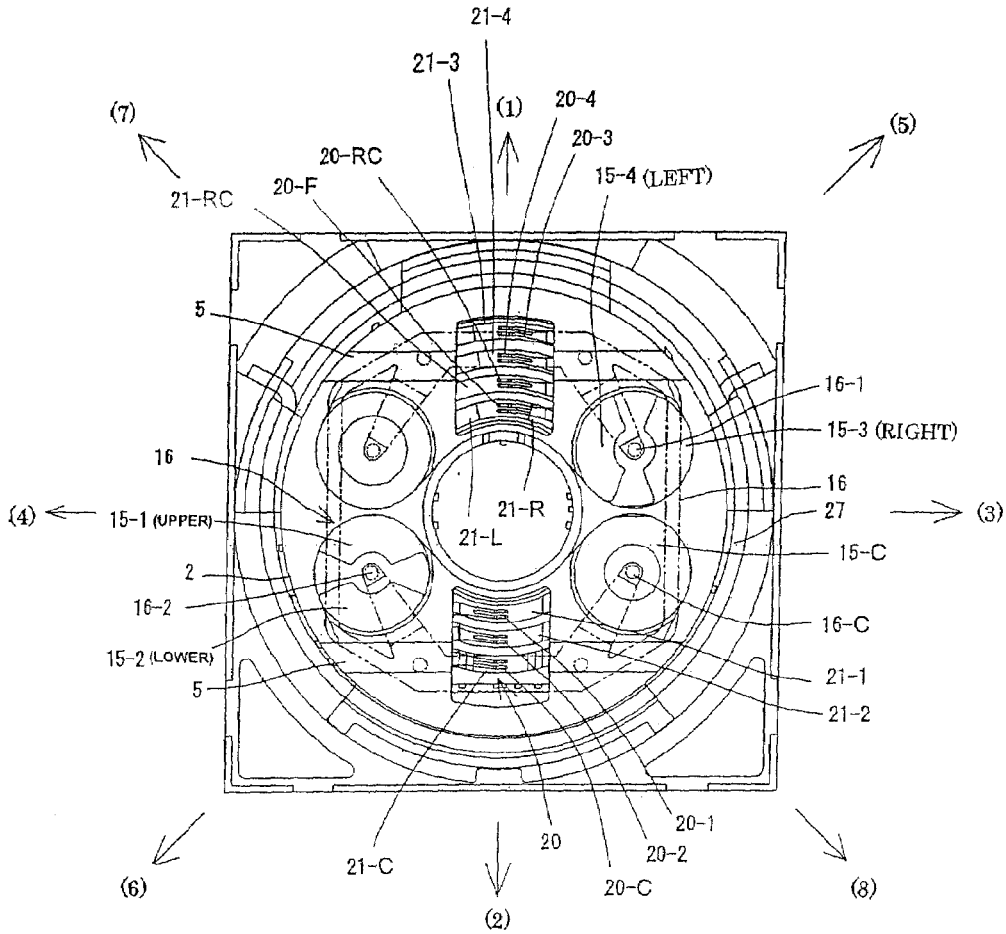
FIG. 7 is a sectional view taken along the line B-B of FIG. 4 or 5.
Figure 8:
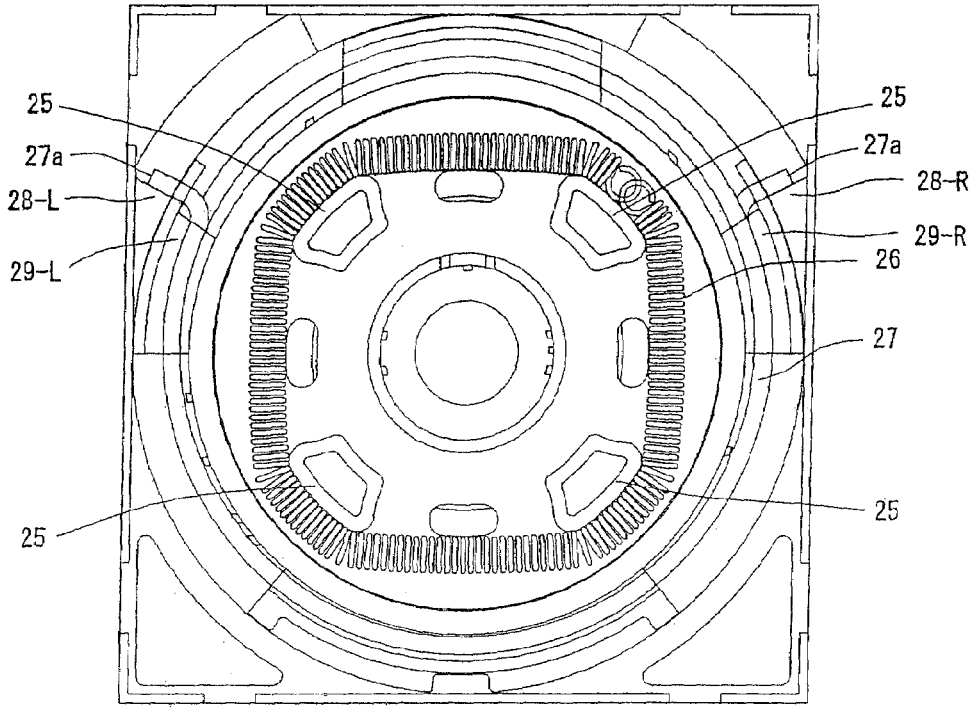
FIG. 8 is a sectional view taken along the line C-C of FIG. 4 or 5.
Figure 9D:
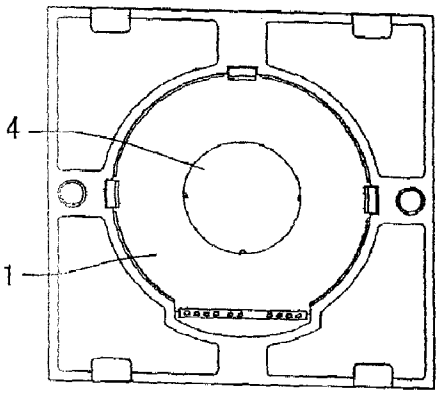
FIG. 9D is a back view of the inner base.
Figure 9C:
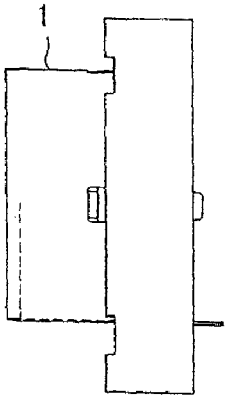
FIG. 9C is a side view of the inner base.
Figure 9E:
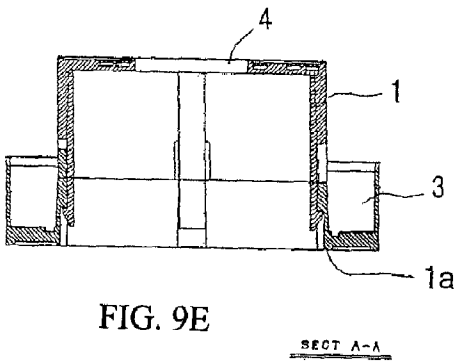
FIG. 9E is a sectional view taken along the line A-A of FIG. 9B.
Figure 9B:
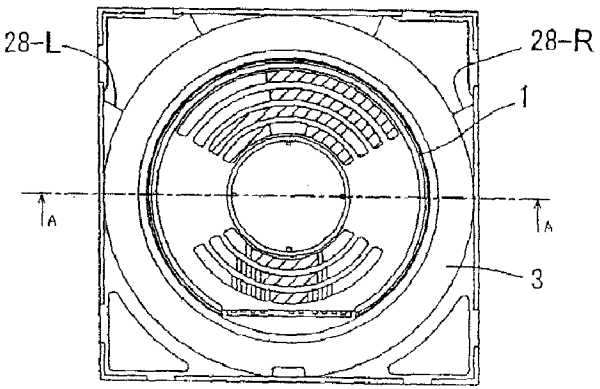
FIG. 9B is a plan view of the inner base.
Figure 9A:
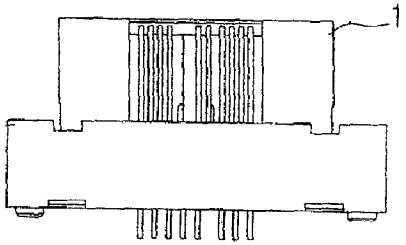
FIG. 9A is a front view of the inner base forming the compound switch.
Figure 10D:
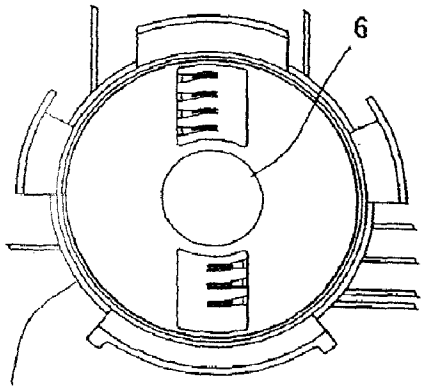
FIG. 10D is a back view of the outer base.
Figure 10C:
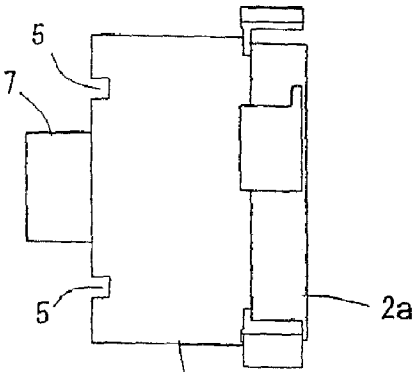
FIG. 10C is a side view of the outer base.
Figure 10B:
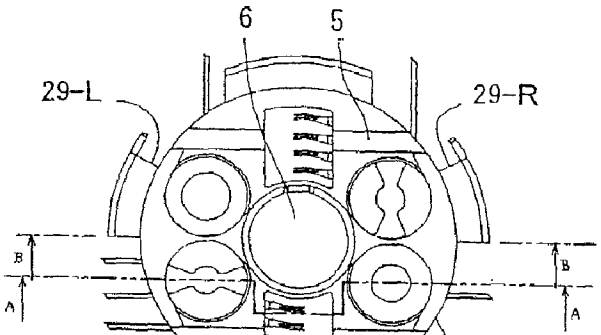
FIG. 10B is a plan view of the outer base.
Figure 10A:
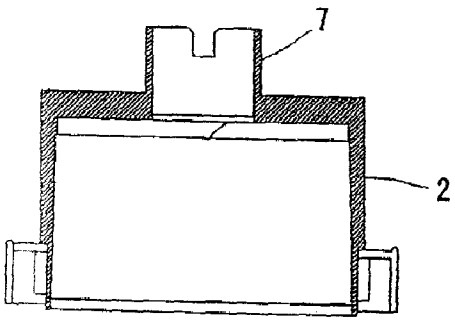
FIG. 10A is a front view of the outer base.
Figure 10A:
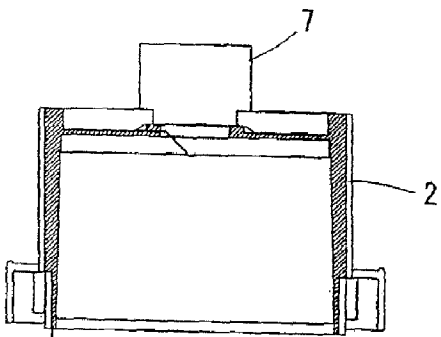
Figure 10A:
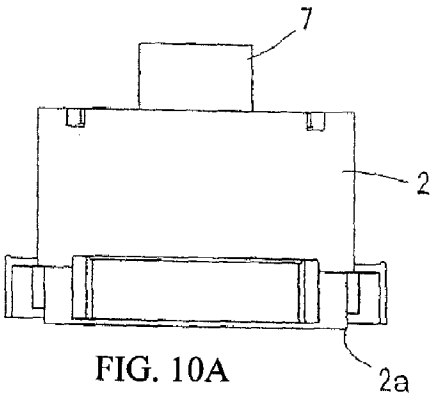
Figure 12D:
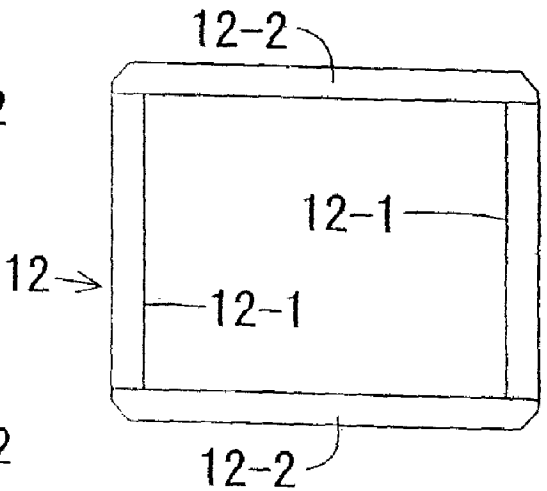
FIG. 12 is explanatory views of a lattice-like guide part forming the compound switch shown in FIG. 1, FIG. 12(A) being a front view of the guide part, FIG. 12(B) being a plan view of the guide part, FIG. 12(C) being a side view of the guide-part, and FIG. 12(D) being a back view of the guide part.
FIG. 12(E) being a sectional side view of the guide-part, along A—A of FIG. 12(B)
Figure 12E:
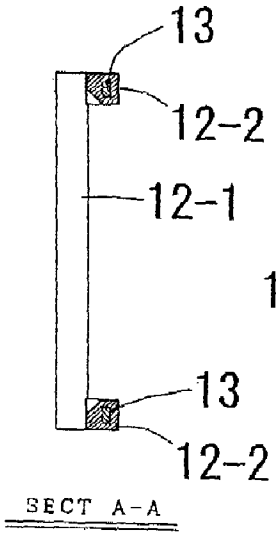
Figure 12C:
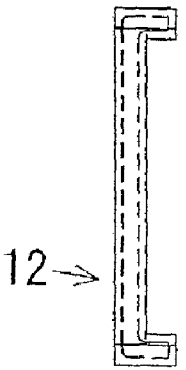
Figure 12B:
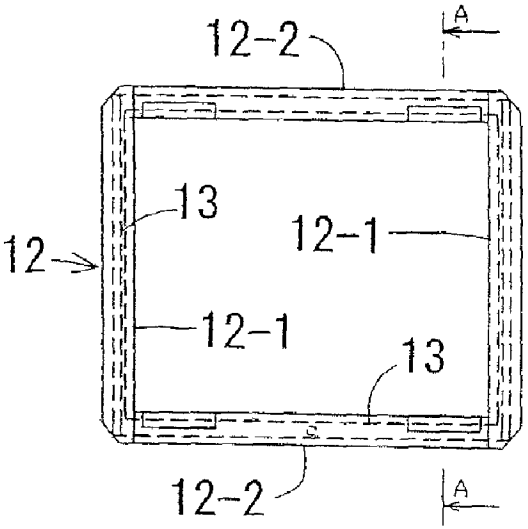
Figure 12A:
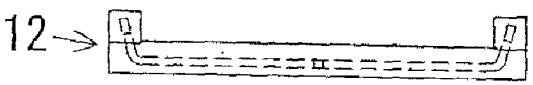
Figure 13A:
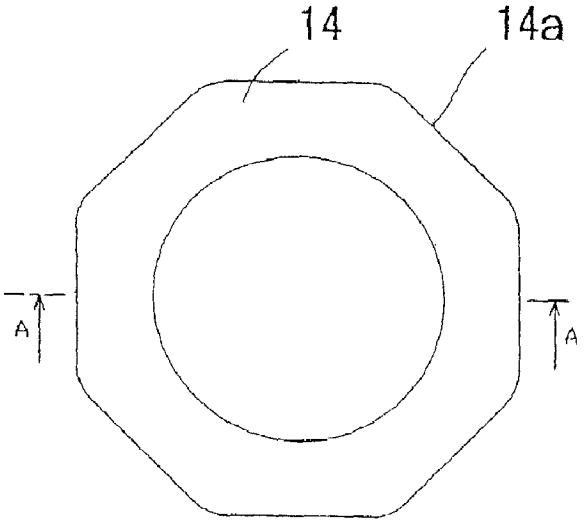
FIG. 13A is a plan view of the operating portion.
Figure 13B:
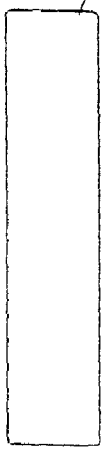
FIG. 13B is a side view of the operating portion.
Figure 13C:
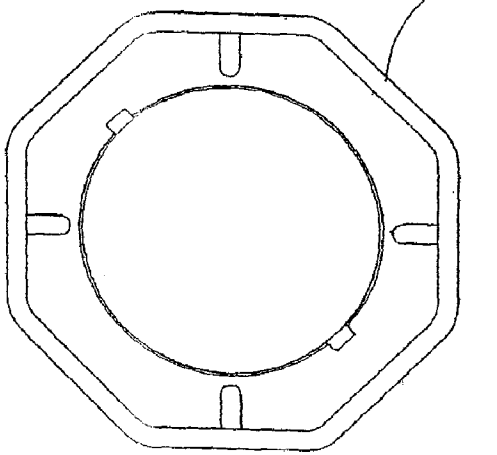
FIG. 13C is a back view of the operating portion.
Figure 13D:
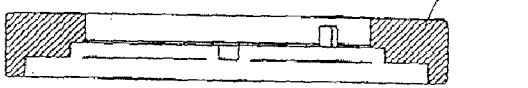
FIG. 13D is a sectional view taken along the line A-A of FIG. 13A.

FIGS. 1A-B is appearance views of a compound switch in accordance with one embodiment of the present invention, FIGS. 2 and 3 are explanatory views of the operation direction of an operating portion forming the compound switch shown in FIGS. 1A-B, FIG. 4 is a sectional view taken along the line A-A of FIGS. 1A-B, FIG. 5 is a sectional view taken along the line B-B of FIGS. 1A-B, FIG. 6 is a sectional view taken along the line A-A of FIG. 4 or 5; FIG. 7 is a sectional view taken along the line B-B of FIG. 4 or 5, and FIG. 8 is a sectional view taken along the line C-C of FIG. 4 or 5.

Figure 2A:
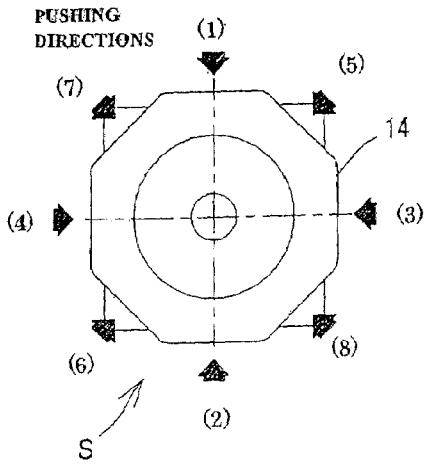
FIG. 2A is an explanatory view of pressing directions of the operating portion at the time when the compound switch shown in FIG. 1A functions as a multidirectional switch.
Figure 2B:
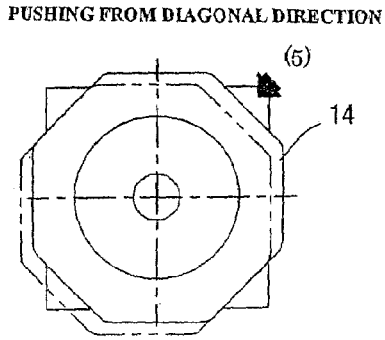
FIG. 2B is an explanatory view of an operation at the time en the operating portion is pressed in the direction indicated by the arrow (5) in FIG. 2A.
Figure 2C:
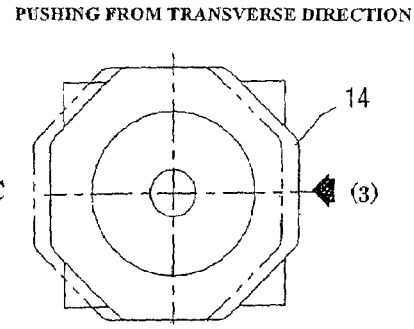
FIG. 2C is an explanatory view of an operation at the time when the operating portion is pressed in the direction indicated by the arrow (3) in FIG. 2A.

The outline of a compound switch S shown in FIGS. 1A-B is explained. This compound switch S is a switch formed by adding the function of a rotary shuttle switch to a multidirectional switch. Specifically, the compound switch S is configured so that both of the multidirectional switch and the rotary shuttle switch are operated by one operating portion 14; namely, the operating portion can be operated in eight directions indicated by the arrows (1) to (8) as shown in FIGS. 2A-C, and also the operating portion 14 can be turned in the directions indicated by the arrows R and L, and a signal is generated according to the operation direction.

Figure 14B:
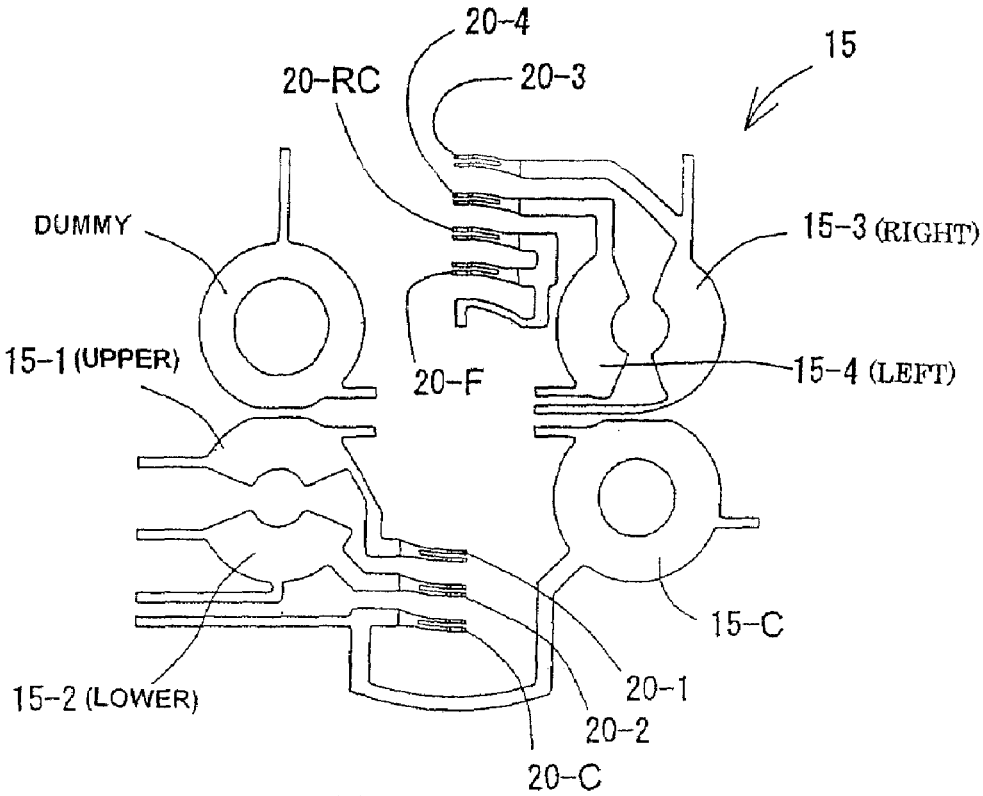
FIG. 14B is a plan view of the outer base fixed contact pattern and the rotary brush.
Figure 14A:
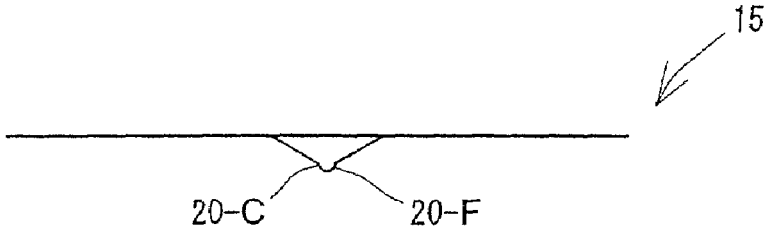
FIG. 14A is a front view of the outer base fixed contact pattern and the rotary brush.
Figure 15A:
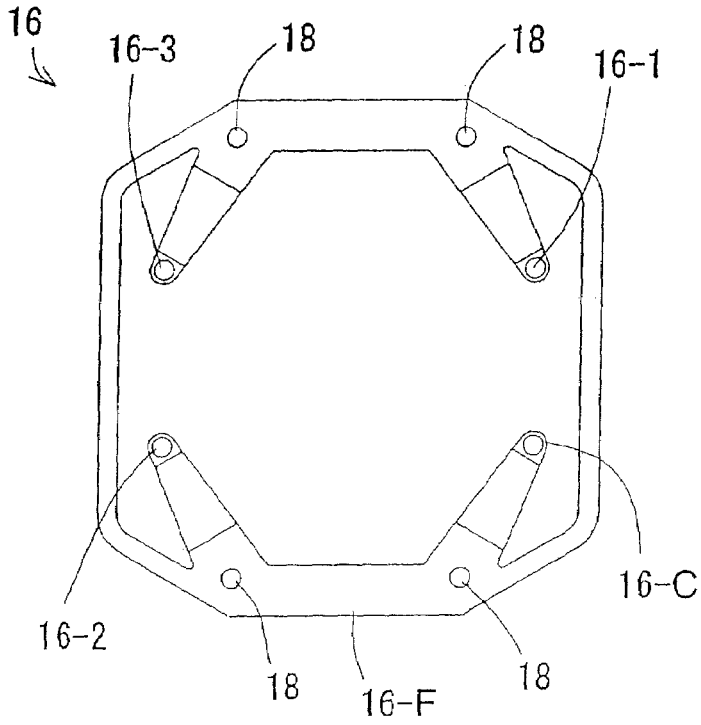
FIG. 15A is a plan view of the slide brush.
Figure 15B:
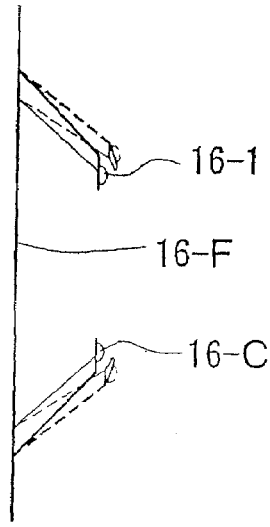
FIG. 15B is a side view thereof.
Figure 16:
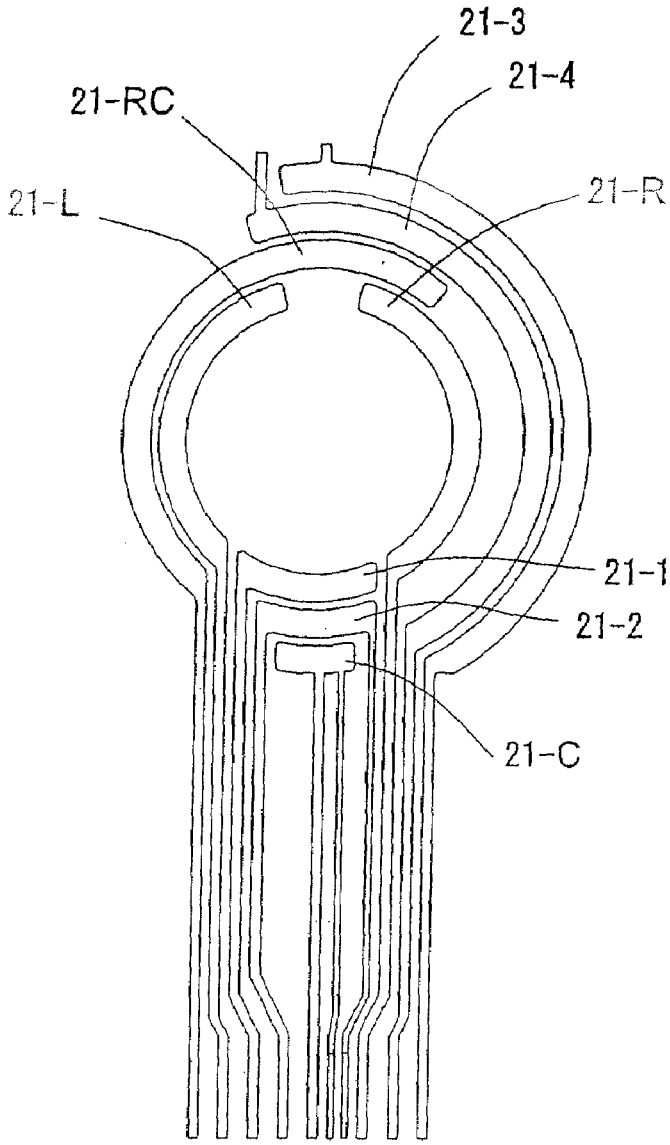
FIG. 16 is a plan view of an inner base fixed contact pattern forming the compound switch shown in FIG. 1A.
Figure 17D:
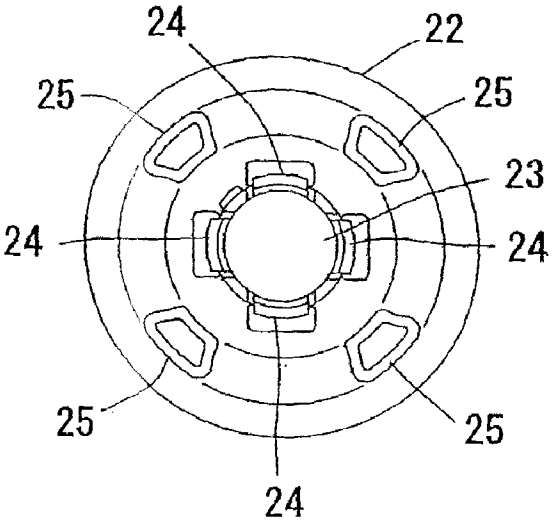
FIG. 17D is a back view of the top case.
Figure 17C:
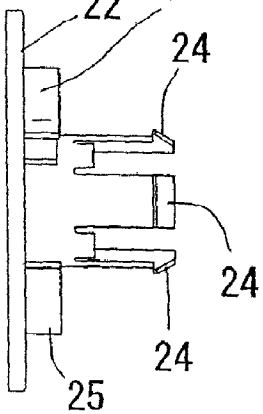
FIG. 17C is a side view of the top case.
Figure 17B:
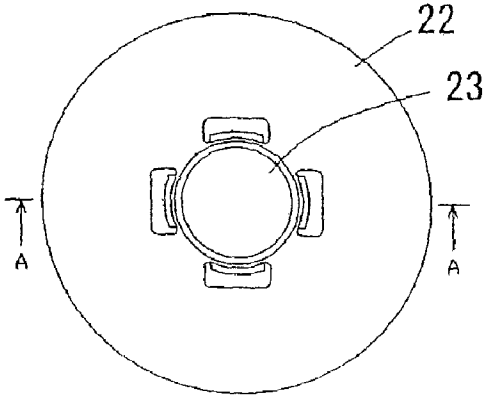
FIG. 17B is a plan view of the top case.
Figure 17A:
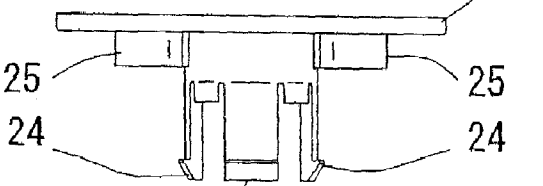
FIG. 17A is a front view of the top case.
Figure 17E:
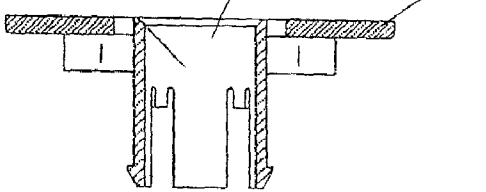
FIG. 17E is a sectional view taken along the line A-A of FIG. 17B.

As shown in FIGS. 4 to 8, the compound switch S shown in FIGS. 1A-B includes switch components such as an inner base shown in FIGS. 9A-E, an outer base shown in FIGS. 10A-F, a slider shown in FIGS. 11A-F, a lattice-like guide part shown in FIGS. 12A-D, the operating portion shown in FIGS. 13A-D, an outer base fixed contact pattern and a rotary brush shown in FIGS. 14A-B, a slide brush shown in FIGS. 15A-B, an inner base fixed contact pattern shown in FIG. 16, and a top case shown in FIGS. 17A-E.

FIGS. 9A-E is explanatory views of the cup-shaped inner base 1 forming the compound switch S shown in FIGS. 1A-B, and FIGS. 10A-F is explanatory views of the cup-shaped outer base 2 forming the compound switch S shown in FIGS. 1A-B. As shown in FIGS. 4 and 5, the compound switch S shown in FIGS. 1A-B adopts a multiple base construction in which the inner base 1 and the outer base 2 are arranged double on the inside and outside so as to be turnably.

The inner base 1 is arranged in a form such that a cup is turned over so as to be directed downward, and a downward cup opening edge 1*a* thereof is formed with an upward annular base receiving groove 3 along the cup opening edge. Further, in the center of the bottom part of the inner base 1, a hole 4 penetrating the top and back surfaces of the base 1 is formed.

Like the inner base 1, the outer base 2 is arranged in a form such that a cup is turned over so as to be directed downward, and is constructed so that a downward cup opening edge 2*a* thereof inserted slidably in the annular base receiving groove 3 of the inner base 1.

In the upper surface of the bottom part of the outer base 2, two transverse grooves 5 directed upward are formed. These transverse grooves 5 are provided in parallel with each other, and are also formed long in the transverse right and left direction (refer to FIG. 10A).

In the center of the bottom part of the outer base 2 as well, a hole 6 penetrating the top and back surfaces of the base 2 is formed. Also, in this embodiment, the outer base 2 adopts a construction such that a cylindrical boss portion 7 surrounding the hole 6 is projectingly formed on the upper surface of the bottom part of the outer base 2.

FIGS. 11A-F is explanatory views of the slider 8 forming the compound switch S shown in FIGS. 1A-B. As shown in FIGS. 4 and 5, this slider 8 is arranged on the upper surface of the bottom part of the outer base 2 so as to be slidable.

On the lower surface of the slider 8, a pair of longitudinal grooves 9 are formed in parallel with each other, and are arranged so as to intersect the transverse grooves 5 in the outer base 2 at right angles.

In the center of the slider 8 as well, a hole 10 penetrating the top and back surfaces of the slider is formed. Further, on the upper surface of the slider 8, four protrusions 11 are formed integrally. These four protrusions 11 are arranged at 90° intervals radially with the hole 10 in the center of the slider 8 being the center.

FIGS. 12A-D show explanatory views of the lattice-like guide part 12 forming the compound switch S shown in FIGS. 1A-B. As shown in FIGS. 4 and 5, this lattice-like guide part 12 is arranged between the slider 8 and the outer base 2, and has a construction such that pairs of bars 12-1 and 12-2 are integrally formed longitudinally and transversely in a lattice shape. More specifically, this lattice-like guide part 12 has a construction such that a pair of bars (hereinafter referred to as "a pair of longitudinal bars 12-1") are positioned in the longitudinal direction in an upper part of the guide part 12, and a pair of bars (hereinafter referred to as "a pair of transverse bars 12-2") are positioned in the transverse direction below the longitudinal bars 12-1.

The lattice-like guide part 12 is provided on the upper surface of the bottom part of the outer base 2 so as to be slidable. The installation mode of the lattice-like guide part 12 is such that the paired transverse bars 12-2 of the lattice-like guide part 12 are slidably inserted in the corresponding paired transverse grooves 5 in the upper surface of the bottom part of the outer base 2. The lattice-like guide part 12 is integrally molded by using a resin etc. In this embodiment, a reinforcing metallic core 13 is embeddedly provided in the longitudinal bars 12-1 and the transverse bars 12-2 at the time of molding.

In this embodiment, a guide means is formed by the lattice-like guide part 12, the paired transverse grooves 5 and the paired longitudinal grooves 9. By this guide means, the slider 8 is guided so as to be slidable in multiple directions on the upper surface of the bottom part of the outer base 2.

If a force in the longitudinal direction indicated by the arrow mark (1) or (2) acts on the slider 8, the slider 8 slides in the direction of that force while being guided by the longitudinal grooves 9 in the lower surface of the slider 8 and the longitudinal bars 12-1 of the lattice-like guide part 12. At this time, only the slider 8 slides independently in the longitudinal direction on the longitudinal bars 12-1 of the lattice-like guide part 12. The reason for this is as described below. When the slider 8 slides in the longitudinal direction, the transverse bars 12-2 of the lattice-like guide part 12 tend to move at right angles to the transverse grooves 5 in the upper surface of the bottom part of the outer base 2. Therefore, the transverse grooves 5 and the transverse bars 12-2 serve as a stopper to restrain the longitudinal movement of the whole of the lattice-like guide part 12, so that the slider 8 slides in the longitudinal direction as described above.

On the other hand, if a force in the transverse direction indicated by the arrow mark (3) or (4) acts on the slider 8, the slider 8 slides in the direction of that force integrally with the lattice-like guide part 12. The reason for this is as described below. When the slider 8 slides in the transverse direction, the longitudinal grooves 9 in the lower surface of the slider 8 abut on the longitudinal bars 12-1 of the lattice-like guide part 12 at right angles, so that the slider 8 slides in the transverse direction as described above.

Also, if a force in the slantwise direction, for example, in an intermediate direction between the arrows (1) and (3) acts on the slider 8, the slider 8 slides in the slantwise direction. The reason for this is as described below. By a force component in the longitudinal direction of the force acting slantwise on the slider 8, the slider 8 slides in the longitudinal direction on the basis of the above-described principle, and at the same time, by the force component in the transverse direction, the slider 8 slides in the transverse direction on the basis of the above-described principle, by which both sliding operations in the transverse direction and the longitudinal direction are synthesized.

FIGS. 13A-D is explanatory views of the operating portion 14 forming the compound switch S shown in FIGS. 1A-B. This operating portion 14 is formed into a ring shape. The operating portion 14 is integrally mounted to the slider 8 by fitting the inside of the ring to the outer periphery of the slider 8 as shown in FIGS. 1A-B, and is formed so that the outer periphery of the ring is polygonal (octagonal in the example shown in FIGS. 13A-D).

FIGS. 14A-B is explanatory views of the outer base fixed contact pattern 15 forming the compound switch S shown in FIGS. 1A-B. This outer base fixed contact pattern 15 is provided integrally on the upper surface of the bottom part of the outer base 2, and has one outer base fixed common contact 15-C and four outer base fixed contacts 15-1 to 15-4 as electrically independent fixed contacts for the multidirectional switch. These five fixed contacts are electrically independent of each other, and are arranged on the upper surface of the bottom part of the outer base 2 so as to be distributed in four directions.

The outer base fixed common contact 15-C located at the lower right in FIGS. 14A-B consists of a doughnut-shaped metal piece, and is arranged at the lower right on the upper surface of the bottom part of the outer base 2 as shown in FIGS. 10A-F. Also, of the four outer base fixed contacts 15-1 to 15-4, two fixed contacts 15-1 and 15-2 located at the lower left in FIGS. 14A-B consist of a pair of fan-shaped metal pieces arranged above and below, and are arranged at the lower left on the upper surface of the bottom part of the outer base 2 as shown in FIGS. 10A-F. Further, two fixed contacts 15-3 and 15-4 located at the upper right in FIGS. 14A-B consist of a pair of fan-shaped metal pieces arranged at the right and left, and are arranged at the upper right on the upper surface of the bottom part of the outer base 2 as shown in FIGS. 10A-F. A doughnut-shaped metal piece located at the upper left in FIGS. 14A-B is a dummy.

Hereunder, of the four outer base fixed contacts, the upper outer base fixed contact 15-1 located at the lower left is called "the upper outer base fixed contact 15-1" and similarly the lower outer base fixed contact 15-2 located at the lower left is called "the lower outer base fixed contact 15-2" as necessary. Also, the right outer base fixed contact 15-3 located at the upper right is called "the right outer base fixed contact 15-3" and similarly the left outer base fixed contact 15-4 located at the upper right is called "the left outer base fixed contact 15-4".

FIGS. 15A-B show explanatory views of the slide brush 16 forming the compound switch S shown in FIGS. 1A-B. The slide brush 16 is integrally attached to the lower surface of the slider 8 so as to face to the outer base fixed contact pattern 15 on the upper surface of the bottom part of the outer base 2 as shown in FIG. 7, and is configured so as to slide in the same direction together with the slider 8.

This slide brush 16 has one slide common contact 16-C and three slide contacts 16-1 to 16-3 as slide contacts for the multidirectional switch, and is constructed so that these four slide contacts are connectingly supported by a metallic support frame 16-F.

As a construction for integrally mounting the slide brush 16 having the above-described construction on the lower surface of the slider 8, in this embodiment, a construction has been adopted in which four pins 17 (refer to FIGS. 11A-F) are provided on the lower surface of the slider 8, and on the other hand, pin holes 18 corresponding to these pins 17 are formed in the support frame 16-F of the slide brush 16, whereby the slide brush 16 is integrally mounted on the lower surface of the slider 8 by inserting and fixing the pins 17 in the pin holes 18. Also, in this mounting construction, a part of the support frame 16-F of the slide brush 16 is accommodated in a frame accommodation groove 19 (refer to FIGS. 11A-F) formed in the bottom surface of the longitudinal groove 9 in the lower surface of the slider 8.

The slider 8 and the slide brush 16 integrated by the above-described mounting construction are installed on the lattice-like guide part 12 with the slide brush 16 side being downward as shown in FIGS. 4 and 5. The installation mode is a mode in which the paired longitudinal bars 12-1 of the lattice-like guide part 12 are inserted slidably in the corresponding paired longitudinal grooves 9 in the lower surface of the slider 8.

FIGS. 14A-B also shows the rotary brush 20 forming the compound switch S shown in FIGS. 1A-B. The rotary brush 20 is integrally provided on the outer base 2 so as to face to the outer surface of the bottom part of the inner base 1, and is configured so as to rotatingly move in the same direction together with the outer base 2.

The rotary brush 20 has, as rotary contacts for the multidirectional switch, five rotary contacts 20-1 to 20-4 and 20-C connected electrically to the outer base fixed common contact 15-C and the outer base fixed contacts 15-1 to 15-4 and, as rotary contacts for the rotary shuttle switch, a rotary common contact 20-RC and a rotary changeover contact 20-F connected electrically to the rotary common contact 20-RC. These seven rotary contacts 20-1 to 20-4, 20-C, 20-RC, and 20-F are arranged on concentric circles with the center of the bottom part of the outer base 2 being the circle center.

FIG. 16 is an explanatory view of the inner base fixed contact pattern 21 forming the compound switch S shown in FIGS. 1A-B. The inner base fixed contact pattern 21 is integrally provided on the upper surface of the bottom part of the inner base 1 so as to face to the rotary brush 20 (refer to FIG. 6).

The inner base fixed contact pattern 21 has eight inner base fixed contacts 21-R, 21-L, 21-RC, 21-C, and 21-1 to 21-4 each consisting of a metal piece as electrically independent fixed contacts. These eight inner base fixed contacts are arranged so as to be formed into an arcuate shape along the contact rotation paths corresponding to the rotary contacts for the multidirectional switch (the five rotary contacts 20-C and 20-1 to 20-4) and the rotary contacts for the rotary shuttle switch (the rotary common contact 20-RC and the rotary changeover contact 20-F) (refer to FIG. 6).

Of the eight inner base fixed contacts, the paired right and left inner base fixed contacts 21-R and 21-L arranged adjacently close to each other on the same concentric circle on the innermost side are provided so as to correspond to the rotary changeover contact 20-F.

Hereunder, the inner base fixed contact 21-R located on the right-hand side in FIG. 16 is called "the right inner base fixed contact 21-R", and the inner base fixed contact 21-L located on the left-hand side in FIG. 16 is called "the left inner base fixed contact 21-L" as necessary.

Also, the inner base fixed contact 21-RC provided on a concentric circle just adjacent to the right and left inner base fixed contacts 21-R and 21-L is provided so as to correspond to the rotary common contact 20-RC. Further, the remaining five inner base fixed contacts 21-C and 21-1 to 21-4 are provided so as to correspond to rotary contacts for the multidirectional switch (the five rotary contacts 20-C and 20-1 to 20-4), respectively.

Hereunder, the inner base fixed contact 21-RC provided corresponding to the rotary common contact 20-RC is called "the inner base fixed contact 21-RC for rotary shuttle switch common" as necessary. Also, of the inner base fixed contacts 21-C and 21-1 to 21-4 provided corresponding to the rotary contacts 20-C and 20-1 to 20-4 for the multidirectional switch, in particular, the inner base fixed contact 21-C provided corresponding to the rotary contact 20-C connected electrically to the outer base fixed common contact 15-C is called "the inner base fixed contact 21-C for multidirectional switch common" as necessary.

FIGS. 17A-E is explanatory views of the top case 22 forming the compound switch S shown in FIGS. 1A-B. The top case 22 is arranged on the slider 8, and is integrally attached and fixed to the outer base 2 via a fixing means (refer to FIGS. 1A-B). In the center of the top case 22 as well, a hole 23 penetrating the top and back surfaces of the top case 22 is formed.

As a specific construction of the fixing means, in this embodiment, a construction is adopted in which four engagement claws 24 are projectingly formed radially with the hole 23 in the center of the top case 22 being the center, these four engagement claws 24 are inserted in the cylindrical boss portion 7 (refer to FIGS. 10A-F) of the outer base 2 and are allowed to project from the hole 6 in the outer base 2, and the projecting engagement claws 24 are hooked to the peripheral edge of the hole 6, by which the top case 22 is attached and fixed to the boss portion 7 of the outer base 2 by single finger motion.

On the lower surface of the top case 22, four spring fixing protrusions 25 are further formed projectingly. These four spring fixing projections 25 are located on the outside of the four engagement claws 24, and are arranged at 90° intervals radially with a hole 23 in the center of the top case 22 being the center. In this embodiment, a construction is adopted in which, as shown in FIG. 8, a tightly wound coil spring 26 is set annularly in a form of a rubber band around the outer peripheries of the four spring fixing projections 25, and the four projections 11 on the upper surface of the slider 8 are arranged in the ring of the tightly wound coil spring 26.

In the compound switch S shown in FIGS. 1A-B, when an operation such that the operating portion 14 is pushed in from the transverse direction with a finger etc. is not performed, the slider 8 does not slide. At this time, the urging force of the tightly wound coil spring 26 acts well-balancedly and evenly on the four protrusions 11 on the upper surface of the slider 8 from the outside toward the inside. Therefore, the slider 8 is held at a fixed position of neutrality. When an operation for pushing in the operating portion 14 from the transverse direction from this state is performed, a transverse push-in force acts on the slider 8 via the operating portion 14, so that the slider 8 slides in the push-in direction. At this time, of the four protrusions 11, the protrusion 11 located in the direction in which the slider 8 advances pushes out a part of the tightly wound coil spring 26 from the inside toward the outside, so that a restoring force at the time when the pushed-out portion tends to return to the original position acts on the slider 8 from the tightly wound coil spring 26. Therefore, when the above-described operation such that the operating portion 14 is pushed in from the transverse direction is stopped, the slider 8 is pushed back by the restoring force of the tightly wound coil spring 26 and returns to the original fixed position of neutrality. As described above, the tightly wound coil spring 26 functions as a means (first urging means) for always urging the slider 8 against the fixed position of neutrality.

As shown in FIGS. 4 and 5, a torsion spring 27 is insertedly set at the outer periphery of the cup edge of the outer base 2. As shown in FIG. 8, both ends 27*a*, 27*a* of the torsion spring 27 that are open outward are hooked to spring locking portions 28-L and 28-R (refer to FIGS. 9A-E) of the inner base 1. Also, at the outer periphery of the cup edge of the outer base 2, a pair of left and right pressing elements 29-L and 29-R (refer to FIGS. 10A-F) for pressing both of the ends of the torsion spring 27 in the direction such that the ends are brought close to each other are formed projectingly.

In the compound switch S shown in FIGS. 1A-B, when an operation such that the operating portion 14 is turned around the axis with a finger etc. is not performed, the outer base 2 does not turn, and is held at the fixed position of neutrality. When an operation for turning the operating portion 14, for example, clockwise (in the direction indicated by the arrow L in FIGS. 3A-B), clockwise torque applied to the operating portion 14 by this operation is transmitted to the outer base 2 via the lattice-like guide part 12 forming the guide means, and hence the outer base 2 is turned clockwise around the axis thereof. At this time, the pressing element 29-L on the left-hand side in FIG. 8 moves while pressing the left end 27*a* of the torsion spring 27, so that the torsion spring 27 is distorted clockwise around the center axis thereof. As a result, a restoring force at the time when the torsion is about to return to the original state acts on the outer base 2 from the torsion spring 27 via the left pressing element 29-L. Therefore, if the operation for turning the operating portion 14 around the axis is stopped, the outer base 2 is pushed back by the restoring force of the torsion spring 27, and returns to the original fixed position of neutrality (shuttle operation). In the case where an operation for turning the operating portion 14 counterclockwise (in the direction indicated by the arrow L in FIGS. 3A-B) as well, the above-described shuttle operation is performed on the same principle. As described above, the torsion spring 27 functions as a means (second urging means) for always urging the outer base 2 against the fixed position of neutrality.

The compound switch S shown in FIGS. 1A-B has a vertical through hole in the central portion thereof. This through hole is made up of the above-described hole 23 in the center of the top case 22, the holes 4 and 6 in the center of the inner and outer bases 1 and 2, the hole 10 in the center of the slider 8, a lattice inside space of the lattice-like guide part 12, which is a central portion of the guide means, and a frame inside space of the support frame 16-F, which is a central portion of the slide brush 16. In this embodiment, as shown in FIGS. 4 and 5, a configuration in which a palm rest 30 is provided above the upper surface of the bottom part of the outer base 2 by utilizing this through hole is adopted. The palm rest 30 has a construction such that a fixing shaft 31 is insertedly provided in the through hole consisting of the above-described holes, and the palm rest 30 is integrally installed at the tip end of the fixing shaft 31. The palm rest 30 is provided so that the operator can easily operate the compound switch by putting his/her palm on the palm rest 30.

Next, the operation of the compound switch configured as described above is explained.

<Operation as a Multidirectional Switch>

In the compound switch shown in FIGS. 1A-B, when no force is applied to the operating portion 14, the slider 8 is located at the fixed position of neutrality. At this time, as shown in FIG. 7, all of the four slide contacts 16-C and 16-1 to 16-3 do not come into contact with any of the fixed contacts 15-1 to 15-4. Specifically, the slide common contact 16-C at the lower right in FIG. 7 is located in an insulating portion provided in the center of the outer base fixed common contact 15-C. Also, the slide contact 16-1 at the upper right is similarly located in an insulating portion provided between the paired right and left outer base fixed contacts 15-3 and 15-4 located at the upper right, and the slide contact 16-2 at the lower left is similarly located in an insulating portion provided between the paired upper and lower outer base fixed contacts 15-1 and 15-2 located at the lower left.

In the compound switch shown in FIGS. 1A-B, when a transverse push-in force is applied to the operating portion 14 by an operation such that the operating portion 14 is pushed in from the transverse direction with a finger etc., the slider 8 slides against the urging force of the tightly wound coil spring 26 in the direction in which the operating portion 14 is pushed in. At this time, at least any one set of the slide contact and the outer base fixed contact, of the slide contacts 16-1 to 16-3 and the outer base fixed contacts 15-1 to 15-4, come into contact with each other, and the slide common contact 16-C comes into contact with the outer base fixed common contact 15-C.

In the compound switch shown in FIGS. 1A-B, even if the slider 8 slides in any direction, the slide common contact 16-C always comes into contact with the outer base fixed common contact 15-C. Also, at the time of sliding, of the total of seven rotary contacts 20-C, 20-RC, 20-F, 20-1 to 20-4, the rotary changeover contact 20-F forming the rotary contact for the rotary shuttle switch does not come into contact with any of the inner base fixed contacts: however, six rotary contacts other than the rotary changeover contact 20-F, namely, the rotary common contact 20-RC forming the rotary contact for the rotary shuttle switch and all of the five rotary contacts 20-C and 20-1 to 20-4 always come into contact with the corresponding inner base fixed contacts.

Hereunder, how the slide contact for the multidirectional switch (the slide common contact 16-C, the three slide contacts 16-1 to 16-3) comes into contact with the fixed contact for the multidirectional switch (the outer base fixed common contact 15-C, the outer base fixed contacts 15-1 to 15-4) is explained for each slide direction.

When the operating portion 14 is pushed in in the direction indicated by the arrow (1) and the slider 8 slides in the direction indicated by the arrow (1) as shown in FIGS. 2A-C, the slide contact 16-2 at the lower left shown in FIG. 7 comes into contact with the upper outer base fixed contact 15-1. At this time, the slide common contact 16-C comes into contact with the outer base fixed common contact 15-C, so that the upper outer base fixed contact 15-1 is connected electrically to the outer base fixed common contact 15-C. Also, at this time, the outer base fixed common contact 15-C is connected electrically to the inner base fixed contact 21-C and the signal output terminal connected to the inner base fixed contact 21-C via the rotary contact 20-C, and further the upper outer base fixed contact 15-1 is connected electrically to the inner base fixed contact 21-1 and the signal output terminal connected to the inner base fixed contact 21-1 via the rotary contact 20-1. In this case, therefore, a signal telling that the slider 8 has slid in the direction indicated by the arrow (1) is generated from the upper outer base fixed contact 15-1 to the outside through the signal output terminal.

When the operating portion 14 is pushed in in the direction indicated by the arrow (2) opposite to the direction indicated by the arrow (1) in FIGS. 2A-C and the slider 8 slides in the direction indicated by the arrow (2), the slide contact 16-2 at the lower left shown in FIG. 7 comes into contact with the lower outer base fixed contact 15-2. At this time, the slide common contact 16-C comes into contact with the outer base fixed common contact 15-C, so that the lower outer base fixed contact 15-2 is connected electrically to the outer base fixed common contact 15-C via the slide brush 16. Also, at this time, the outer base fixed common contact 15-C is electrically connected to the inner base fixed contact 21-C and the signal output terminal connected to the inner base fixed contact 21-C via the rotary contact 20-C, and further the lower outer base fixed contact 15-2 is connected electrically to the inner base fixed contact 21-2 and the signal output terminal connected to the inner base fixed contact 21-2 via the rotary contact 20-2. In this case, therefore, a signal telling that the slider 8 has slid in the direction indicated by the arrow (2) is generated from the lower outer base fixed contact 15-2 to the outside through the signal output terminal.

When the operating portion 14 is pushed in in the direction indicated by the arrow (3) and the slider 8 slides in the direction indicated by the arrow (3) as shown in FIGS. 2A-C, the slide contact 16-1 at the upper right shown in FIG. 7 comes into contact with the right outer base fixed contact 15-3. At this time, the slide common contact 16-C comes into contact with the outer base fixed common contact 15-C, so that the right outer base fixed contact 15-3 is connected electrically to the outer base fixed common contact 15-C via the slide brush 16. Also, at this time, the outer base fixed common contact 15-C is connected electrically to the inner base fixed contact 21-C and the signal output terminal connected to the inner base fixed contact 21-C via the rotary contact 20-C, and further the right outer base fixed contact 15-3 is connected electrically to the inner base fixed contact 21-3 and the signal output terminal connected to the inner base fixed contact 21-3 via the rotary contact 20-3. In this case, therefore, a signal telling that the slider 8 has slid in the direction indicated by the arrow (3) is generated from the right outer base fixed contact 15-3 to the outside through the signal output terminal.

When the operating portion 14 is pushed in in the direction indicated by the arrow (4) opposite to the direction indicated by the arrow (3) in FIGS. 2A-C and the slider 8 slides in the direction indicated by the arrow (4), the slide contact 16-1 at the upper right shown in FIG. 7 comes into contact with the left outer base fixed contact 15-4. At this time, the slide common contact 16-C comes into contact with the outer base fixed common contact 15-C, so that the left outer base fixed contact 15-4 is connected electrically to the outer base fixed common contact 15-C via the slide brush 16. Also, at this time, the outer base fixed common contact 15-C is electrically connected to the inner base fixed contact 21-C and the signal output terminal connected to the inner base fixed contact 21-C via the rotary contact 20-C, and further the left outer base fixed contact 15-4 is connected electrically to the inner base fixed contact 21-4 and the signal output terminal connected to the inner base fixed contact 21-4 via the rotary contact 20-4. In this case, therefore, a signal telling that the slider 8 has slid in the direction indicated by the arrow (4) is generated from the left outer base fixed contact 15-4 to the outside through the signal output terminal.

When the operating portion 14 is pushed in in the direction indicated by the arrow (5) (the slantwise upper right direction) and the slider 8 slides in the direction indicated by the arrow (5) as shown in FIGS. 2A-C, the slide contact 16-1 at the upper right shown in FIG. 7 comes into contact with the right outer base fixed contact 15-3, and at the same time, the slide contact 16-2 at the lower left comes into contact with the upper outer base fixed contact 15-1. At this time, the slide common contact 16-C comes into contact with the outer base fixed common contact 15-C, so that the right outer base fixed contact 15-3 and the upper outer base fixed contact 15-1 are connected electrically to the outer base fixed common contact 15-C via the slide brush 16. Also, at this time, the outer base fixed common contact 15-C is connected electrically to the inner base fixed contact 21-C and the signal output terminal connected to the inner base fixed contact 21-C via the rotary contact 20-C, and further the right outer base fixed contact 15-3 is connected electrically to the inner base fixed contact 21-3 and the signal output terminal connected to the inner base fixed contact 21-3 via the rotary contact 20-3. Also, the upper outer base fixed contact 15-1 is also connected electrically to the inner base fixed contact 21-1 and the signal output terminal connected to the inner base fixed contact 21-1 via the rotary contact 20-1. In this case, therefore, two signals telling that the slider 8 has slid in the direction indicated by the arrow (5) (the slantwise upper right direction) are generated to the outside through the two signal output terminals at the same time.

When the operating portion 14 is pushed in in the direction indicated by the arrow (6) (the slantwise upper right direction) opposite to the direction indicated by the arrow (5) in FIGS. 2A-C and the slider 8 slides in the direction indicated by the arrow (6), the slide contact 16-1 at the upper right shown in FIG. 7 comes into contact with the left outer base fixed contact 15-4, and at the same time, the slide contact 16-2 at the lower left comes into contact with the lower outer base fixed contact 15-2. At this time, the slide common contact 16-C comes into contact with the outer base fixed common contact 15-C, so that the left outer base fixed contact 15-4 and the lower outer base fixed contact 15-2 are connected electrically to the outer base fixed common contact 15-C via the slide brush 16. Also, at this time, the outer base fixed common contact 15-C is connected electrically to the inner base fixed contact 21-C and the signal output terminal connected to the inner base fixed contact 21-C via the rotary contact 20-C, and further the left outer base fixed contact 15-4 is connected electrically to the inner base fixed contact 21-4 and the signal output terminal connected to the inner base fixed contact 21-4 via the rotary contact 20-4. Further, the lower outer base fixed contact 15-2 is also connected electrically to the inner base fixed contact 21-2 and the signal output terminal connected to the inner base fixed contact 21-2 via the rotary contact 20-2. In this case, therefore, two signals telling that the slider 8 has slid in the direction indicated by the arrow (6) (the slantwise upper right direction) are generated to the outside through the two signal output terminals at the same time.

When the operating portion 14 is pushed in in the direction indicated by the arrow (7) (the slantwise upper left direction) and the slider 8 slides in the direction indicated by the arrow (7) as shown in FIGS. 2A-C, the slide contact 16-1 at the upper right shown in FIG. 7 comes into contact with the left outer base fixed contact 15-4, and at the same time, the slide contact 16-2 at the lower left comes into contact with the upper outer base fixed contact 15-1. At this time, the slide common contact 16-C comes into contact with the outer base fixed common contact 15-C, so that the left outer base fixed contact 15-4 and the upper outer base fixed contact 15-1 are connected electrically to the outer base fixed common contact 15-C via the slide brush 16. Also, at this time, the outer base fixed common contact 15-C is connected electrically to the inner base fixed contact 21-C and the signal output terminal connected to the inner base fixed contact 21-C via the rotary contact 20-C, and further the left outer base fixed contact 15-4 is connected electrically to the inner base fixed contact 21-4 and the signal output terminal connected to the inner base fixed contact 21-4 via the rotary contact 20-4. Further, the upper outer base fixed contact 15-1 is also connected electrically to the inner base fixed contact 21-1 and the signal output terminal connected to the inner base fixed contact 21-1 via the rotary contact 20-1. In this case, therefore, two signals telling that the slider 8 has slid in the direction indicated by the arrow (7) (the slantwise upper left direction) are generated to the outside through the two signal output terminals at the same time.

When the operating portion 14 is pushed in in the direction indicated by the arrow (8) (the slantwise lower right direction) opposite to the direction indicated by the arrow (7) in FIGS. 2A-C and the slider 8 slides in the direction indicated by the arrow (8), the slide contact 16-1 at the upper right comes into contact with the right outer base fixed contact 15-3, and at the same time, the slide contact 16-2 at the lower left comes into contact with the lower outer base fixed contact 15-2. At this time, the slide common contact 16-C comes into contact with the outer base fixed common contact 15-C, so that the right outer base fixed contact 15-3 and the lower outer base fixed contact 15-2 are connected electrically to the outer base fixed common contact 15-C via the slide brush 16. Also, at this time, the outer base fixed common contact 15-C is connected electrically to the inner base fixed contact 21-C and the signal output terminal connected to the inner base fixed contact 21-C via the rotary contact 20-C, and further the right outer base fixed contact 15-3 is connected electrically to the inner base fixed contact 21-3 and the signal output terminal connected to the inner base fixed contact 21-3 via the rotary contact 20-3. Also, the lower outer base fixed contact 15-1 is also connected electrically to the inner base fixed contact 21-1 and the signal output terminal connected to the inner base fixed contact 21-1 via the rotary contact 20-1. In this case, therefore, two signals telling that the slider 8 has slid in the direction indicated by the arrow (8) (the slantwise lower right direction) are generated to the outside through the two signal output terminals at the same time.

<Operation as a Jog Shuttle Slide Switch>

In the case where the outer base 2 is located at the fixed position of neutrality, of the seven rotary contacts 20-1 to 20-4, 20-C, 20-RC, and 20-F, the rotary changeover contact 20F forming the rotary contact for the rotary shuttle switch does not come into contact with any of the inner base fixed contacts; however, all of the six rotary contacts other than the rotary changeover contact 20F, namely, the rotary common contact 20-RC forming the rotary contact for the rotary shuttle switch and five rotary contacts 20-C and 20-1 to 20-4 forming the rotary contact for the multidirectional switch always come into contact with the corresponding inner base fixed contacts.

In the state in which the outer base 2 is located at the fixed position of neutrality as described above, for example, when torque for turning the operating portion 14 clockwise (in the direction indicated by the arrow R) around the axis of the operating portion 14 is applied by performing an operation for turning the operating portion 14 around the axis thereof with a finger etc. as shown in FIGS. 3A-B, the torque is transmitted to the outer base 2 via the guide means consisting of the slider 8, the lattice-like guide part, and the like. Then, the outer base 2 and the rotary brush 20 integrally move rotatingly in the rotation direction of the operating portion 14 from the fixed position of neutrality against the urging force of the torsion spring 27 shown in FIG. 7. Thereby, the rotary changeover contact 20-F is brought into contact with the inner base fixed contact located in the rotation advance direction of the rotary changeover contact 20-F of the paired left and right inner base fixed contacts 21-L and 21-R, namely, the right inner base fixed contact 21-R. At this time, the rotary common contact 20-RC is in contact with the corresponding inner base fixed contact, namely, the inner base fixed contact 21-RC for rotary shuttle switch common. Therefore, the right inner base fixed contact 21-R and the inner base fixed contact 21-RC for rotary shuttle switch common are connected electrically to each other via the rotary changeover contact 20-F and the rotary common contact 20-RC. In this case, therefore, a signal telling that the operating portion 14 has turned clockwise is generated from the right inner base fixed contact 21-R through the signal output terminal connected to the right inner base fixed contact 21-R.

When torque for turning the operating portion 14 counterclockwise around the axis of the operating portion 14 is applied contrary to the above description, the outer base 2 and the rotary brush 20 integrally turn counterclockwise, and thereby the rotary changeover contact 20-F is brought into contact with the left inner base fixed contact 21-L. At this time, the rotary common contact 20-RC is in contact with the inner base fixed contact 21-RC for rotary shuttle switch common. Therefore, the left inner base fixed contact 21-L and the inner base fixed contact 21-RC for rotary shuttle switch common are connected electrically to each other via the rotary changeover contact 20-F and the rotary common contact 20-RC. In this case, therefore, a signal telling that the operating portion 14 has turned counterclockwise is generated from the left inner base fixed contact 21-L through the signal output terminal connected to the left inner base fixed contact 21-L.

When the operating portion 14 is turned in either one direction of the right and left directions as described above, of the five rotary contacts forming the rotary contact for the multidirectional switch, the rotary contact 20-C connected electrically to the outer base fixed common contact 15-C gets out of the inner base fixed contact 21-C for multidirectional switch common, and thus an on-contact state is formed. Therefore, the multidirectional switch does not operate when the operating portion 14 is rotatingly operated. Even if the compound switch operator pushes in the operating portion 14 mistakenly together with the operation for turning the operating portion 14, only the signal based on the rotation is generated, and the signal based on the mistaken push-in operation, namely, the signal telling that the slider 8 has slid in the direction indicated by the arrow (1) or any other direction is not generated, so that a wrong signal based on misoperation is prevented from being generated.

As is apparent from the above description, the compound switch of the above-described embodiment functions as a multidirectional switch capable of obtaining a contact state corresponding to the slide direction of the slider 8 sliding in the push-in direction and also functions as a rotary shuttle switch capable of obtaining a contact state corresponding to the rotation direction of the slider 8 by an operation for pushing in one operating portion 14 in the transverse direction or an operation for turning the operating portion 14 around the axis of the operating portion 14. Therefore, the number of switch operating portions arranged in a planar form on a switch mounting panel surface, for example, on the front surface of dashboard of a vehicle, so that the switch operability can be improved and the switch mounting panel surface can be simplified.

Also, the compound switch of the above-described embodiment has a construction such that when torque for turning the operating portion 14 around the axis thereof is applied to the operating portion 14, the torque is transmitted to the outer base 2 via the guide means consisting of the slider 8, the lattice-like guide part 12, and the like, and thereby the outer base 2, the slider 8, and the operating portion 14 are rotatingly moved together in the rotation direction of the operating portion 14 from the fixed position of neutrality against the urging force of the torsion spring 27. Therefore, even if the operating portion 14 is turned, an unreasonable turning force does not act on the slider 8 or the guide means therefor, so that malfunction as a multidirectional switch caused by the damage to the slider 8 or the guide means therefor can be prevented effectively.

In the above-described embodiment, an example has been explained in which a multidirectional switch S1 capable of obtaining eight different continuity states. However, the present invention is not limited to this embodiment. Such a multidirectional switch S1 may be configured so that eight or more different continuity states can be obtained by appropriately changing the outer base fixed contact pattern 15 etc.

What is claimed is:

1. A compound switch functioning as a multidirectional switch capable of obtaining a contact state corresponding to a slide direction sliding in a push-in direction and also functioning as a rotary shuttle switch capable of obtaining a contact state corresponding to a rotation direction by an operation for pushing in one operating portion in a transverse direction or an operation for turning the operating portion around an axis thereof, wherein the compound switch comprises:

a multiple base in which a cup-shaped inner base and a cup-shaped outer base are arranged such that the cup-shaped inner base fits within the cup-shaped outer base and that the inner and outer base are turnable;

a slider which is provided slidably on an upper surface of a bottom part of the outer base and is integrally mounted with the operating portion at an outer periphery;

a guide means which is provided between the slider and the outer base to slidably guide the slider in multiple directions on the upper surface of the bottom part of the outer base;

a first urging means for always urging the slider against a fixed position of neutrality;

a second urging means for always urging the outer base against a fixed position of neutrality;

an outer base fixed contact pattern provided integrally on the upper surface of the bottom part of the outer base;

a slide brush integrally attached to a lower surface of the slider so as to face the outer base fixed contact pattern;

a rotary brush integrally provided on the outer base so as to face an outer surface of a bottom part of the inner base; and an inner base fixed contact pattern integrally provided on an upper surface of the bottom part of the inner base so as to face the rotary brush, wherein when a transverse push-in force is applied to the operating portion, the slider slides in a push-in direction of the operating portion from the fixed position of neutrality against an urging force of the first urging means, and at this time, the slide brush and the outer base fixed contact pattern form a contact state corresponding to the slide direction, and when torque for turning the operating portion around an axis thereof is applied to the operating portion, the torque is transmitted to the outer base via the slider and the guide means, by which the outer base and the operating portion are rotatingly moved together in a rotation direction of the operating portion from the fixed position of neutrality against an urging force of the second urging means, and at this time, the rotary brush and the inner base fixed contact pattern form a contact state corresponding to the rotation direction.

2. The compound switch according to claim 1, wherein the compound switch comprises:

a multiple base in which a cup-shaped inner base and a cup-shaped outer base are arranged double on an inside and an outside so as to be turnable;

a slider which is provided slidably on an upper surface of a bottom part of the outer base and is integrally mounted with the operating portion at an outer periphery;

a guide means which is provided between the slider and the outer base to slidably guide the slider in multiple directions on the upper surface of the bottom part of the outer base;

a first urging means for always urging the slider against a fixed position of neutrality;

a second urging means for always urging the outer base against a fixed position of neutrality;

an outer base fixed contact pattern provided integrally on the upper surface of the bottom part of the outer base;

a slide brush integrally attached to a lower surface of the slider so as to face the outer base fixed contact pattern;

a rotary brush integrally provided on the outer base so as to face an outer surface of a bottom part of the inner base; and an inner base fixed contact pattern integrally provided on an upper surface of the bottom part of the inner base so as to face the rotary brush, the outer base fixed contact pattern being provided with an outer base fixed common contact for a multidirectional switch and a plurality of outer base fixed contacts, which are arranged so as to be distributed in all directions;

the slide brush being provided with a plurality of slide contacts provided as slide contacts for the multidirectional switch so as to correspond to a slide common contact provided corresponding to the outer base fixed common contact and the outer base contacts;

the rotary brush being provided with a plurality of rotary contacts, as rotary contacts for the multidirectional switch, which are connected electrically to the outer base fixed common contact and the outer base fixed contacts, and being provided with a rotary common contact and a rotary changeover contact connected electrically to the rotary common contact as rotary contacts for the rotary shuttle switch, these rotary contacts being arranged on a concentric circle with a bottom part center of the outer base being the center; and the inner base fixed contact pattern being provided with a plurality of inner base fixed contacts formed and arranged along contact rotation paths corresponding to the rotary contacts for the multidirectional switch and the rotary contacts for the rotary shuttle switch, wherein when a transverse push-in force is applied to the operating portion, the slider slides in a push-in direction of the operating portion from the fixed position of neutrality against an urging force of the first urging means, and at this time, at least any one set of slide contact and outer base fixed contact, of the slide contacts and the outer base fixed contacts, come into contact with each other according to the slide direction, and a state in which the slide common contact and the outer base fixed common contact are in contact with each other is formed, and when torque for turning the operating portion around an axis thereof is applied to the operating portion, the torque is transmitted to the outer base via the slider and the guide means, by which the outer base and the operating portion are rotatingly moved together in the rotation direction of the operating portion from the fixed position of neutrality against an urging force of the second urging means, and at this time, the rotary changeover contact comes into contact with the corresponding inner base fixed contact according to the rotation direction, and a state in which the rotary common contact is in contact with the corresponding inner base fixed contact is formed.

3. The compound switch according to claim 1, wherein the operating portion has a polygonal outer periphery.

4. The compound switch according to claim 1, wherein the compound switch further comprises a hole vertically penetrating bottom part centers of the inner and outer bases, centers of the slider and the switch operating portion, a center of the guide means, and a center of the slide brush, and a palm rest is provided above the upper surface of the bottom part of the outer base via a fixing shaft inserted in the hole.

5. The compound switch according to claim 1, wherein the first urging means has a construction such that protrusions on an upper surface of the slider are arranged in a ring of a tightly wound coil spring set annularly.

6. The compound switch according to claim 2, wherein when the operating portion is turned in either one direction of right and left, the rotary contact connected electrically to the outer base fixed common contact gets out of the corresponding inner base fixed contact, and hence a non-contact state is formed.

* * * * *